US008468792B2

(12) United States Patent
Winzen

(10) Patent No.: US 8,468,792 B2
(45) Date of Patent: Jun. 25, 2013

(54) FIBER GUIDE CHANNEL DEVICE FOR AN OPEN-END SPINNING MECHANISM

(75) Inventor: Lothar Winzen, Erkelenz (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 0 days.

(21) Appl. No.: 13/368,622

(22) Filed: Feb. 8, 2012

(65) Prior Publication Data

US 2012/0204530 A1 Aug. 16, 2012

(30) Foreign Application Priority Data

Feb. 11, 2011 (DE) ..... 10 2011 010 925

(51) Int. Cl.
*D01H 4/08* (2006.01)

(52) U.S. Cl.
USPC ..... 57/413

(58) Field of Classification Search
USPC ..... 57/412, 413, 417
See application file for complete search history.

(56) References Cited

U.S. PATENT DOCUMENTS

| | | | | |
|---|---|---|---|---|
| 5,555,717 | A * | 9/1996 | Schuller et al. | 57/413 |
| 5,953,897 | A | 9/1999 | Wassenhoven et al. | |
| 6,016,650 | A | 1/2000 | Legrom | |
| 6,324,826 | B1 * | 12/2001 | Schuller et al. | 57/417 |
| 7,036,301 | B2 * | 5/2006 | Wassenhoven | 57/404 |
| 7,347,040 | B2 * | 3/2008 | Voidel et al. | 57/413 |
| 2007/0277497 | A1 | 12/2007 | Haaken et al. | |

FOREIGN PATENT DOCUMENTS

| | | | |
|---|---|---|---|
| DE | 19603730 | A1 | 8/1997 |
| DE | 10359417 | A1 | 7/2005 |
| WO | 2006021241 | A1 | 3/2006 |

OTHER PUBLICATIONS

Search Report of the German Patent and Trademark Office, Feb. 12, 2011.

* cited by examiner

*Primary Examiner* — Shaun R Hurley
(74) *Attorney, Agent, or Firm* — K&L Gates LLP

(57) ABSTRACT

A fiber guide channel device for an open-end spinning mechanism with a fiber guide channel body, for fixation in an opening roller housing and having a receiving opening for a fiber guide channel insert in the region of a fiber guide channel entry defining a central fiber guide channel for pneumatically transporting individual fibers combed by an opening roller from a feed sliver to a high speed spinning rotor in a negative pressure rotor housing. The fiber guide channel body (14) is configured of a plastics material and the fiber guide channel insert (27) is manufactured as a sleeve-like annularly-closed component of a highly abrasion-resistant material.

6 Claims, 3 Drawing Sheets

FIBER GUIDE CHANNEL DEVICE FOR AN OPEN-END SPINNING MECHANISM

FIELD OF THE INVENTION

The invention relates to a fiber guide channel device for an open-end spinning mechanism.

BACKGROUND OF THE INVENTION

Fiber guide channel devices have been known for a long time in conjunction with sliver opening devices of open-end rotor spinning machines and have been described in detail in numerous patent applications.

In open-end rotor spinning mechanisms, which are equipped with a sliver opening device of this type, a sliver intermediately stored in a spinning can is fed to a rotating opening roller, which combs the sliver into individual fibers. The combed-out individual fibers are then pneumatically supplied by means of a so-called fiber guide channel to a spinning rotor revolving at a high rotational speed in a rotor housing and continuously rotated in the rotor groove thereof onto the end of a yarn leaving the spinning rotor by means of a yarn withdrawal device. The yarn produced by the open-end rotor spinning mechanism is then wound on an associated winding device to form a cross-wound bobbin.

In open-end rotor spinning mechanisms of this type, relatively high demands are made of the configuration of the sliver opening device and the fiber guide channel devices, in particular with regard to the fiber guide channel, by means of which the individual fibers combed out by the opening roller are pneumatically transported to the spinning rotor.

The fiber guide channel devices should, for example, not only have an advantageous geometric configuration, but also be optimally designed with regard to the surface quality of their fiber guide channel.

In other words, in fiber guide channel devices of this type, flow conditions should prevail within the fiber guide channel, which ensure that the fibers are drawn, or remain drawn, during transportation and the possibility of fibers being detained in the fiber guide channel during the pneumatic fiber transportation is to be prevented.

An open end rotor spinning mechanism with a sliver opening device, in which the fiber guide channel device is configured as a separate pressure die casting, is described in German Patent Publication DE 197 12 881 A1. The pressure die casting, in this case, apart from a central fiber guide channel, has a foot part with a centering device and an annular groove to receive a sealing ring. By means of the foot part, the pressure die casting can be fixed at a precise angle and in an air-tight manner in a corresponding bore of the opening roller housing and attached by its mouth region to a central channel plate adapter receiver in the cover element of the open-end spinning mechanism. The mouth region is, in this case, also connected in an air-tight manner to the channel plate adapter receiver by means of a corresponding seal. In order to increase the service life of the components, these known fiber guide channel devices are generally also provided with a wear-protection, in other words, the pressure die castings are immersed in a nickel dispersion bath or the like.

The above-described fiber guide channel devices have proven successful in practice and are used in large piece numbers in open-end rotor spinning mechanisms.

Similar fiber guide channel devices are known from German Patent Publication DE 103 59 417 A1. These fiber guide channel devices, however, additionally have an insertion piece made of a ceramic material in the region of the entry opening of the fiber guide channel.

This insertion piece, which is non-rotatably positioned in a corresponding recess of the fiber guide channel foot, in the region of the entry opening of the fiber guide channel, forms a narrow point, which significantly reduces the internal channel cross-section, which leads to an increase in the flow speed of the transportation air flow in this region. The reduction in the internal cross-section of the fiber guide channel in the region of the entry opening has certainly proven successful especially in cotton yarns, but in other fiber materials, for example polyester or polyester mixtures, difficulties may occur upon the entry of the fibers into the fiber guide channel. Moreover, the arrangement of an insert piece of this type in the entry region of the fiber guide channel leads to a noticeable impairment of the surface quality of the fiber guide channel. In other words, narrow gaps running in the fiber transportation direction, in which individual fibers may be detained, can hardly be avoided between the fiber guide channel wall and the insert piece.

The drawback in the above-described fiber guide channel devices is also their manufacturing as zinc or aluminium pressure die castings, since, as is known, manufacturing of this type leads to permanently high tool costs. Moreover, in this method of manufacturing, the rejection quota is relative high, in particular because of the high quality demands of the surface quality in the region of the fiber guide channel.

Fiber guide channel devices, which are comparable in form, are known from German Patent Publication DE 10 2004 005 429 A1, but these fiber guide channel devices are not manufactured as zinc or aluminium pressure die castings, but produced by a special manufacturing method, which is also called MIM (Metal Injection Molding) or PIM (Powder Injection Molding) technology.

In MIM technology or PIM technology, a first oversized preform is firstly produced from a mixture of a sinterable material and a binder by injection molding, said preform being converted by releasing agents into a porous intermediate form and brought by sintering into a final form requiring little aftertreatment. The final bodies produced after the sintering can be subjected virtually without further aftertreatment in subsequent finishing processes to all conceivable heat treatment and surface treatment methods.

SUMMARY OF THE INVENTION

Proceeding from the aforementioned prior art, an object of the invention is to further improve the known fiber guide channel devices.

The improved fiber guide channel devices are not only to be able to be economically produced but also to have a long service life and optimal functionality.

This object is achieved according to the invention by a fiber guide channel device for an open-end spinning mechanism having a fiber guide channel body, which can be fixed in an opening roller housing and which, in the region of its fiber guide channel entry, has a receiving opening for a fiber guide channel insert. The fiber guide channel insert has a central fiber guide channel by means of which individual fibers, which are combed by an opening roller from a feed sliver, are pneumatically transported to a spinning rotor revolving at a high rotational speed in a negative pressure-loadable rotor housing. According to the invention, the fiber guide channel body is configured of a plastics material and the fiber guide channel insert is manufactured as a sleeve-like component, which is fully closed annularly and comprises a highly abrasion-resistant material.

The above-described configuration according to the invention of the fiber guide channel device with a fiber guide channel body of a plastics material with a receiving opening in the region of its fiber guide channel entry in which is positionable an sleeve-like annularly-closed fiber guide channel insert of a highly abrasion-resistant material, inter alia, has the advantage that fiber guide channel devices of this type are economical to manufacture. Moreover, using a fiber guide channel device configured in this manner, it can relatively easily be ensured that no individual fibers can be detained in the fiber guide channel.

By manufacturing the fiber guide channel insert from a highly abrasion-resistant material it is furthermore ensured that the fiber guide channel devices according to the invention in each case have a long service life.

A long service life of this type of the fiber guide channel device is, in particular, provided when the fiber guide channel insert is produced from an industrial ceramic material. An industrial ceramic material of this type, for example oxide ceramic, as is known, has the advantage that it is very wear-resistant and that, despite the heavy stress to be expected, a long service life of the fiber guide channel insert is ensured. The fiber guide channel insert is subjected to such relatively heavy stress in particular in the region of the so-called fiber separation edge.

According to another feature of the invention, the fiber guide channel insert, in an advantageous embodiment, has a fiber guide region, the internal cross-section of which is adapted to the internal cross-section of the fiber guide channel in the region of the fiber guide channel entry. In other words, the internal cross-section of the fiber guide region of the fiber guide channel insert is selected such that it is slightly below the internal cross-section of the fiber guide channel entry. A configuration of this type not only means that the production of gaps in the fiber transportation direction is reliably avoided, but the possibility of any obstacles projecting transverse to the fiber transportation direction, on which individual fibers could be detained during their pneumatic transportation to the spinning rotor, in the transition region between the fiber guide channel insert and fiber guide channel body, is also avoided.

In accordance with another feature of the invention, it is also provided in an advantageous embodiment that the fiber guide channel insert has a collar-like attachment piece with a portion which, in the operating state of the fiber guide channel device, forms a fiber separation edge for the individual fibers combed out by the opening roller. In other words, the collar-like attachment piece, at its lower side, has a portion which is configured as a concavely curved face and, together with a corresponding rounded area on the fiber guide channel foot, forms an air guide face, the radius of which is slightly above the radius of the opening roller revolving in the opening roller housing.

In a further advantageous configuration of the invention, it is provided that the receiving opening of the fiber guide channel body has a contact edge arranged parallel to the rotational axis of the opening roller in the installed state and a guide groove corresponding with a guide attachment piece on the fiber guide channel insert. Proper positioning of the fiber guide channel insert in the receiving opening of the fiber guide channel body can relatively easily be ensured by a configuration of this type, in other words, incorrect positioning of the fiber guide channel insert in the receiving opening can be reliably avoided.

According to another feature, it is furthermore provided that the central fiber guide channel in the fiber guide channel body has a wear-protected surface. In other words, the fiber guide channel of the fiber guide channel device is covered with a hard protective layer by a suitable treatment method. A fiber guide channel body which, although made of a plastics material, has a high degree of stability, can be economically realised by a wear-protected surface of this type.

BRIEF DESCRIPTION OF THE DRAWINGS

The invention will be described in more detail below with the aid of an embodiment shown in the drawings, in which.

DETAILED DESCRIPTION OF THE PREFERRED EMBODIMENTS

Figure 1:
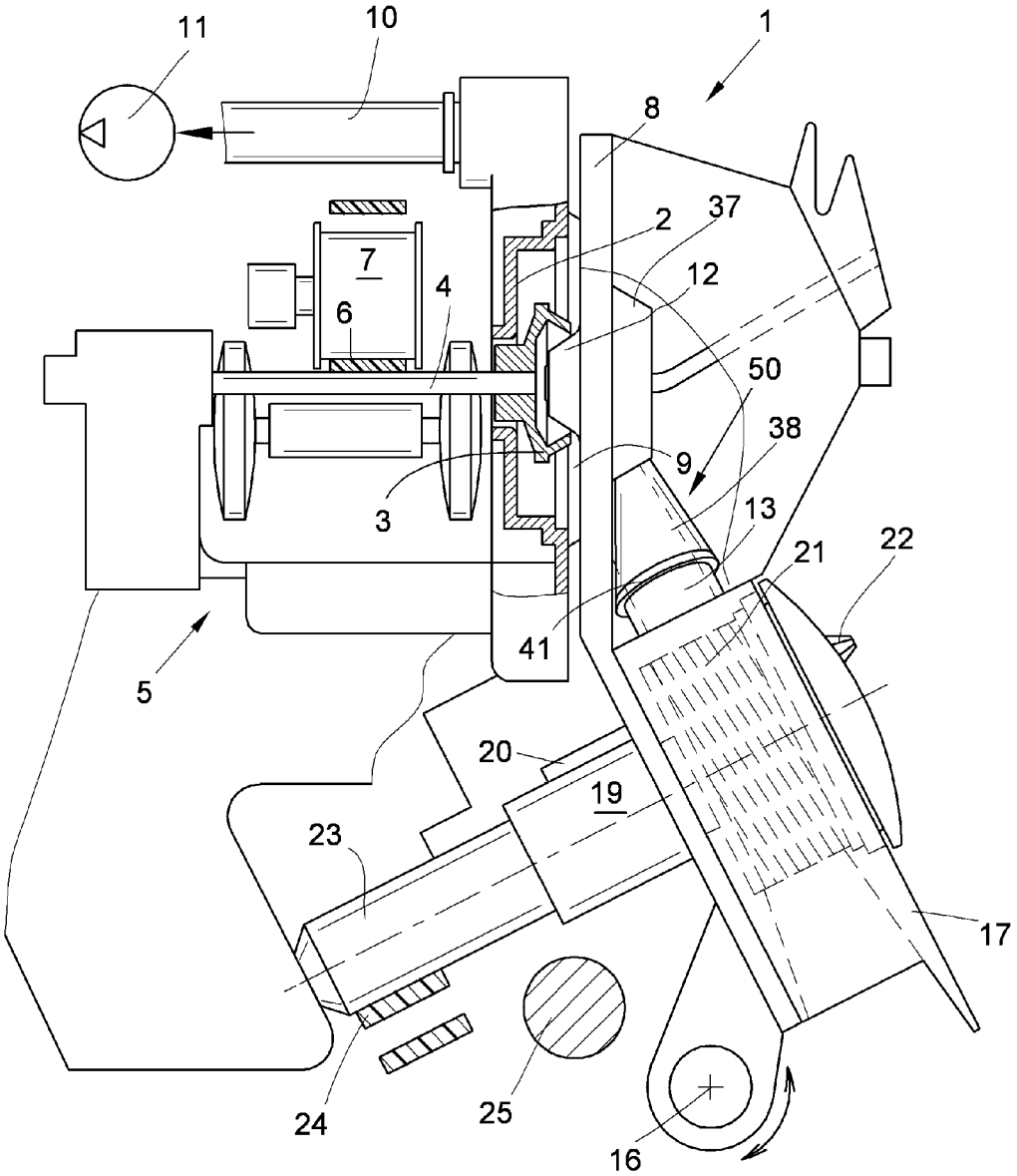
FIG. 1 shows a side view of an open-end spinning mechanism, with a fiber guide channel device arranged between a sliver opening device and a channel plate adapter receiver.

The open-end rotor spinning mechanism 1 shown in FIG. 1 has, as known, a rotor housing 2, in which a spinning rotor 3 revolves at a high rotational speed. In the embodiment, the spinning rotor 3 is supported by its rotor shaft 4 in the interstice of a support disc bearing 5 and is driven by a tangential belt 6 along the length of the machine, which is driven by a tension roller 7.

In an alternative embodiment, the spinning rotor 3 could obviously also be driven by a single motor and contactlessly supported, for example, in a permanent magnet bearing.

The rotor housing 2, open at the front per se, is closed during spinning operation by a pivotably mounted cover element 8, in which a channel plate 37 with a receiver for an exchangeable channel plate adapter 12 and an annular groove for a seal 9 are integrated.

The rotor housing 2 is also attached by a corresponding pneumatic line 10 to a negative pressure source 11, which, during spinning operation, produces the necessary negative spinning pressure in the rotor housing 2. As described above, but not described in more detail in the figures, an exchangeable channel plate adapter 12 which, as conventional, at the front has a yarn withdrawal nozzle and the mouth region of an outlet side fiber guide channel portion, is arranged in a receiving opening of the channel plate 37. This outlet-side fiber guide channel portion, in the operating state, adjoins an entry-side fiber guide channel portion formed by the fiber guide channel 13 of a fiber guide channel device 50. The cover element 8, which is rotatably mounted to a limited extent about a pivot axle 16, has an opening roller housing 17 and rear bearing brackets 19, 20 for mounting an opening roller 21 or a sliver feed cylinder 22. As indicated, the opening roller 21 in the embodiment is driven by a revolving tangential bent 24 along the length of the machine in the region of its wharve 23, while the sliver feed cylinder 22 is preferably driven by a worm gear arrangement (not shown), which is connected to a drive shaft 25 along the length of the machine.

In an alternative embodiment, individual motor drives can obviously also be provided here for the opening roller 21 and/or the sliver feed cylinder 22.

Figure 2:
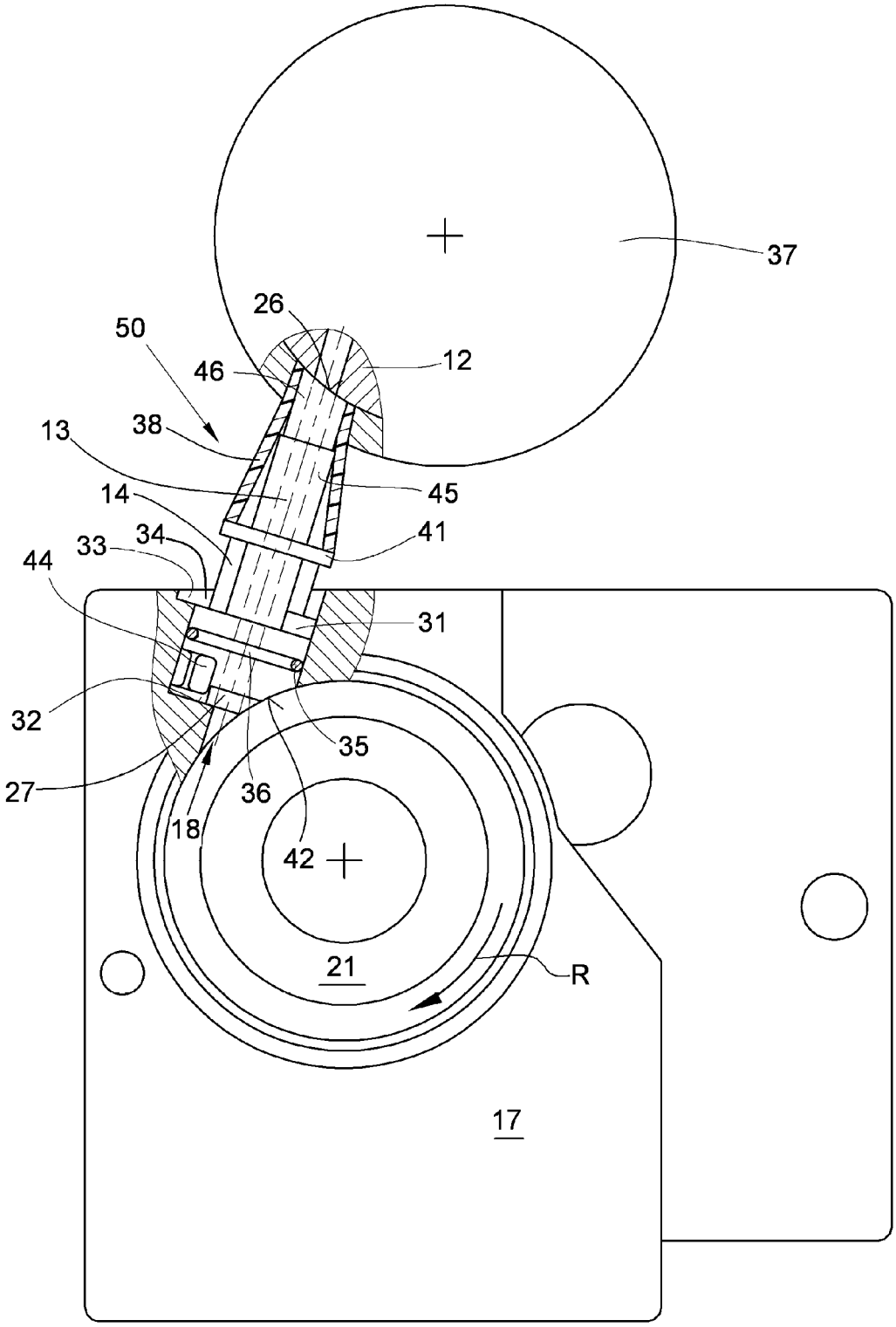
FIG. 2 shows the fiber guide channel device according to FIG. 1 in a front view, partially in section.

FIG. 2 schematically shows a front view of an opening roller housing 17 with an opening roller 21 and a fiber guide channel device 50 according to the invention. The fiber guide channel device 50, in this case, has a fiber guide channel 14 positioned precisely in a connection bore 31 of the opening roller housing 17, with a central fiber guide channel 13, the fiber guide channel body 14 preferably being configured as a plastics material part. As shown, the connection bore 31 has a stop step 32, on which the fiber guide channel body 14 is supported in the installed state. The connection bore 31 furthermore has a side recess 33, in which a position fixing device 34 arranged on the fiber guide channel body 14 engages. The fiber guide channel body 14 is in turn sealed relative to the connection bore 31 of the opening roller housing 17 by an O-ring seal 35, which is positioned in a corresponding annular groove 36 of the fiber guide channel foot 44. The fiber guide channel body 14 is sealed relative to the channel plate 37 and therefore relative to the channel plate adapter 12 arranged in a receiver of the channel plate 37, in the embodiment shown, by a tube nozzle 38, which is supported on contact shoulder 41 of the fiber guide channel body 14.

As furthermore indicated in FIG. 2, and explained in more detail below with the aid of FIGS. 3 and 4, the fiber guide channel body 14, in the operating state, is equipped with a fiber guide channel insert 27, which is fixed in the region of the fiber guide channel entry 18 of the fiber guide channel body 14 in a receiving opening 15.

Figure 4:
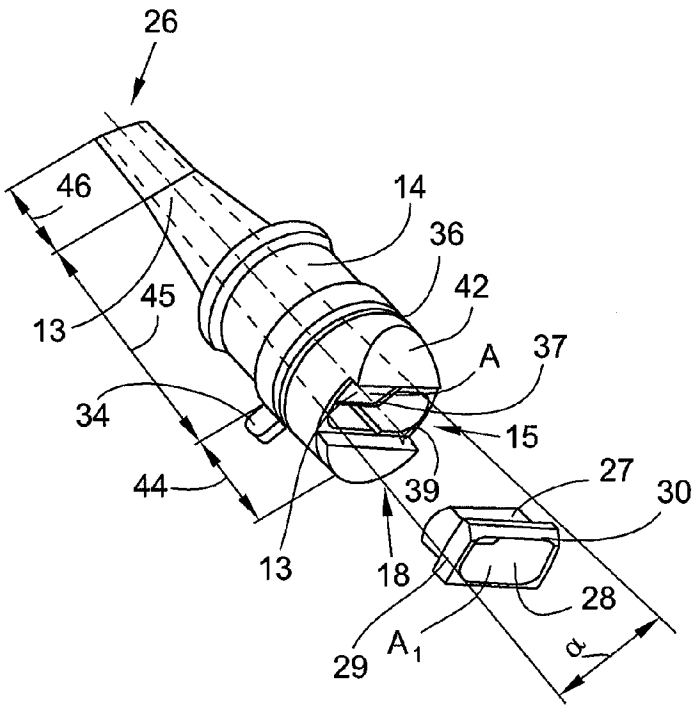
FIG. 4 shows the fiber guide channel body and the fiber guide channel insert before assembly.
Figure 3:
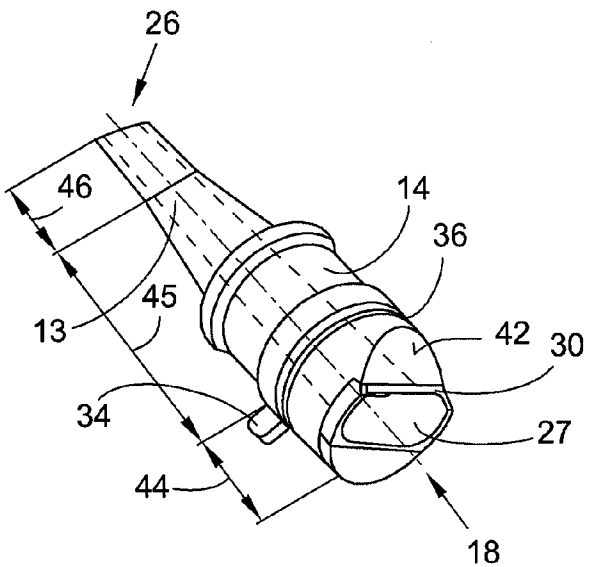
FIG. 3 shows the fiber guide channel body with an installed fiber guide channel insert.

As FIGS. 3 and 4 show, the fiber guide channel body designated as a whole by the reference numeral 14 is configured as a hollow body and has a central fiber channel 13, the internal cross-section A of which decreases from the fiber guide channel entry 18 to its mouth 26. In other words, in relation to its width, the fiber guide channel 13 tapers conically within the fiber guide channel body at an angle $\alpha$. The fiber guide channel body 14 furthermore has a cross-sectionally circular fiber guide channel foot 44, seen in plan view, a partially conically tapering central portion 45 and a cylindrical mouth portion 46. An annular groove 36 to receive an O-ring seal 35 is, in this case, arranged in the fiber guide channel foot 44. Moreover, the fiber guide channel foot 44 has a concave rounded area 42 for adaptation to the opening roller receiver in the opening roller housing 17. This rounded area 42, as described in more detail below, when the fiber guide channel insert 27 is installed, passes into a portion 30, which is part of a collar-like attachment piece 29 of the fiber guide channel attachment piece 27.

As can be seen, in particular from FIG. 4, a receiving opening 15, in which, as already indicated above, a fiber guide channel insert 27 can be fixed, is arranged in the region of the fiber guide channel entry 18. The fiber guide channel insert 27 is configured as a sleeve-like component closed annularly, i.e., all the way around, and preferably manufactured from a highly abrasion-resistant material. The fiber guide channel insert 27, the internal cross-section $A_1$ of which is matched to the internal cross-section A of the fiber guide channel 13 in the region of the fiber guide channel entry 18, has a collar-like attachment piece 29, one side of the collar-like attachment piece 29 corresponding with a stop edge 39 on the fiber guide channel body 14.

The collar-like attachment piece 29, on its lower side, also has a portion 30, which is configured as a concavely curved air guide face, the radius of which is slightly above the diameter of the opening roller 21 revolving in the opening roller housing 17. As can be seen, in particular, from FIG. 2, the portion 30 of the fiber guide channel insert 27, during spinning operation, forms a so-called fiber separation edge for the individual fibers combed out by the opening roller 21.

As already described above, the fiber guide channel body 14 has a circular fiber guide channel foot 44, viewed in cross-section, a position fixing device 34 being formed above the fiber guide channel foot 44 on the fiber guide channel body 14, which position fixing device, as can be seen, in particular, from FIG. 2, engages in a corresponding recess 33 of the connection bore 31 in the opening roller housing 17 and therefore predetermines the precise installation position of the fiber guide channel body 14. Arranged on the central portion 45 of the fiber guide channel body 14 is a contact shoulder 41, on which a tube nozzle 38 is supported in the installed state. As conventional, the fiber guide channel 13 integrated in the fiber guide channel body 14 tapers conically in the central portion 45, in relation to its width.

The mouth portion 46 that is cylindrical with respect to its outer form, on the other hand, has a fiber guide channel portion, the internal cross-section of which remains virtually constant over the entire length. This means that, in this fiber guide channel portion, which makes up approximately a fifth of the total length of the fiber guide channel 13, a steadying of the individual fibers to be fed into the spinning rotor takes place.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A fiber guide channel device for an open-end spinning mechanism comprising a fiber guide channel body, which can be fixed in an opening roller housing and which, in the region of a fiber guide channel entry, has a receiving opening for a fiber guide channel insert defining a central fiber guide channel for pneumatically transporting individual fibers, which are combed by an opening roller from a feed sliver, to a spinning rotor revolving at a high rotational speed in a negative pressure-loadable rotor housing, wherein the fiber guide channel body (14) is configured of a plastics material and the fiber guide channel insert (27) is configured of a highly abrasion-resistant material as a sleeve-like component fully closed in its annular extent.

2. A fiber guide channel device according to claim 1, wherein the fiber guide channel insert (27) is produced from an industrial ceramic material.

3. A fiber guide channel device according to claim 1, wherein the fiber guide channel insert (27) has a fiber guide region (28), the internal cross-section ($A_1$) of which is matched to the internal cross-section (A) of the fiber guide channel (13) in the region of the fiber guide channel entry (18).

4. A fiber guide channel device according to claim 1, wherein the fiber guide channel insert (27) has a collar-like attachment piece (29) with a portion (30), which, in the operating state of the fiber guide channel device (50), forms an abrasion-resistant fiber separation edge for the individual fibers combed out by the opening roller (21).

5. A fiber guide channel device according to claim 1, wherein the receiving opening (15) in the fiber guide channel body (14) has a contact edge (39) arranged parallel to the rotational axis of the opening roller (21) in the installed state and a guide groove (40) is provided, which corresponds with a guide attachment piece on the fiber guide channel insert (27).

6. A fiber guide channel device according to claim 1, wherein the central fiber guide channel (13) has a wear-protected surface within the fiber guide channel body (14).

* * * * *